United States Patent [19]

Hill et al.

[11] Patent Number: 4,680,879

[45] Date of Patent: Jul. 21, 1987

[54] UNDERWATER DREDGING APPARATUS AND CUTTER HEAD THEREFOR

[75] Inventors: Charles E. Hill; Edwin L. Hill; Ernest W. Hill, all of Virginia Beach, Va.

[73] Assignee: PJH, Inc., Norfolk, Va.

[21] Appl. No.: 749,864

[22] Filed: Jun. 28, 1985

[51] Int. Cl.[4] ..... E02F 3/92

[52] U.S. Cl. ..... 37/67; 37/72; 277/82

[58] Field of Search ..... 37/64–67, 37/61–63, 54, 58, 71, 72, 189; 277/82; 114/249; 212/268; 299/90

[56] References Cited

U.S. PATENT DOCUMENTS

| | | | |
|---|---|---|---|
| 404,891 | 6/1889 | Brown | 37/67 |
| 890,764 | 6/1908 | Geare . | |
| 1,797,600 | 3/1931 | Baer et al. | 114/249 X |
| 2,494,887 | 1/1950 | Lenhart | 227/82 X |
| 2,911,111 | 11/1959 | Grove | 212/268 |
| 3,168,466 | 2/1965 | Milne | 210/94 |
| 3,253,357 | 5/1966 | Allard | 37/65 |
| 3,471,949 | 10/1969 | Cargile, Jr. | 37/64 |
| 3,495,409 | 2/1970 | Riedemann | 37/67 X |
| 3,543,422 | 12/1970 | Plutchak | 37/63 X |
| 3,885,330 | 5/1975 | Araoka | 37/57 |
| 4,146,982 | 4/1979 | Norisegi | 37/64 |
| 4,204,347 | 5/1980 | Wolters | 37/67 |
| 4,386,785 | 6/1983 | Back | 277/82 |
| 4,545,588 | 10/1985 | Nagai et al. | 277/82 X |

FOREIGN PATENT DOCUMENTS

| | | | |
|---|---|---|---|
| 558047 | 8/1932 | Fed. Rep. of Germany | 37/58 |
| 16739 | 2/1981 | Japan | 37/54 |
| 92978 | 12/1959 | Netherlands | 37/67 |
| 7611570 | 10/1976 | Netherlands | 37/67 |
| 7701070 | 8/1978 | Netherlands | 37/58 |
| 162 | of 1868 | United Kingdom | 37/189 |
| 302446 | 6/1971 | U.S.S.R. | 37/67 |
| 767294 | 10/1980 | U.S.S.R. | 37/67 |
| 1113482 | 9/1984 | U.S.S.R. | 37/58 |

OTHER PUBLICATIONS

Toyo Pumps, North American Corporation publication entitled "Toyo Pump Configurations for Use with Hydraulic Arms".

"All Pumps Were Not Created Equal"–Toyo Pumps Brochure.

"BX: The Versatile Seal for ANSI & API Pumps in Chemical and Petrochemical Services"–Borg Warner Brochure.

*Primary Examiner*—Clifford D. Crowder

*Attorney, Agent, or Firm*—Stevens, Davis, Miller & Mosher

[57] ABSTRACT

A boom pivotally mounted for rotation about a vertical axis on a support vehicle which may be a floating barge or heavy truck. The boom is extensible and retractable in the radial direction and mounts, at a distal end, a cable supporting a dredging apparatus. The dredging apparatus in a preferred embodiment comprises a single cutter head assembly mounted above and just forward of a single pump both of which are driven by electric power supplied by a generator on the support vehicle. In a preferred embodiment, the cutter head comprises a central support section and a plurality of blades attached to the central support section at each end with a mid-portion extending outwardly of the support section. In a further preferred embodiment, the pump assembly comprises an electric motor in a sealed housing, connected to a pump including an impeller driven by a shaft connecting the impeller and the electric motor. The rotating shaft is supported by a bearing and between the bearing and the impeller portion of the pump, a mechanical seal is substituted for conventional elastomeric seals. In a further preferred embodiment, where it is desirable to operate two or more floating vessels, each vessel is equipped with a tab extending outwardly from a side of the vessel and the tabs of adjoining vessels can be connected together by way of a bolt or pin.

11 Claims, 9 Drawing Figures

UNDERWATER DREDGING APPARATUS AND CUTTER HEAD THEREFOR

BACKGROUND OF THE INVENTION

1. Field of the Invention

The present invention relates generally to underwater dredging apparatuses and specifically to electrically powered cutter and suspension pump combinations.

2. Discussion of the Prior Art

Dredging systems generally mounted on floating barges have been in existence for many years. By means of an A-arm or ladder assembly, pivotally mounted on the front of the barge, a cutter head and suction tube are maintained in proximity to the bottom which is being dredged. The cutter head being powered by an electric or hydraulic motor has protrusions from it which scrape and otherwise disturb sand, mud and rocks on the bottom. The temporary suspension of bottom materials in the water resulting from the cutter head action is sucked through a suction tube and discharged away from the area of dredging in order that the solid materials may settle out and not fill in the area of dredging.

In typical dredging operations, the dredge is positioned over the area to be dredged and operations are commenced with the movement of the cutter head and suction device being controlled by movement of the entire barge itself. In some instances, the barge can be pivotally mounted for rotation about one end such that the dredging operations are commenced along an arcuate path spaced radially outward from the pivot point. However, it is necessary that the pivot point be changed in order to dredge the next subsequent arcuate path when clearing a channel or similar extended area. Thus, dredging operations are characterized by the need to constantly reposition the barge in order to progress in the dredging operations.

In several newer types of dredging apparatuses, a submersible electric motor powers a high volume impeller pump for sucking and propelling suspended particles of bottom material through a discharge pipe to a location some distance away from the dredging operations. In such prior art devices, two cutter head assemblies were generally mounted parallel with each other and the electric motor and pump assembly combination was suspended above and between the two cutter head assemblies. It was well-known that two cutter head assemblies were necessary. The cutter heads were rotated in opposite directions in order to prevent the torque from one cutter head assembly from rotating the entire cutter head/pump unit. Additionally, it was thought that the location of the pump inlet above the cutter head provided the optimum location for ingestion of suspended bottom matter disturbed by the cutter head assembly.

The cutter head assemblies generally comprised an electric or hydraulic motor powering a rotating shaft which has a cutter head located on the end. Typically, a cutter head as shown in FIG. 3 comprises an input shaft 10 which is connected to the electric motor at one end and to the cutter head assembly 12 at the other end. A generally conical shell section 14 has a plurality of teeth 16 extending therefrom. As the conical shell section rotates under the influence of drive shaft 10, in proximity to the bottom material, teeth 16 abrade and dig up the bottom material. The sand and silt bottom material is forced into suspension in the water thus facilitating the ingestion of the suspension into the pump and transport to the discharge pipe some distance away from the dredging area.

A typical electric motor/pump assembly is illustrated in FIG. 5 which shows the electric motor 20 and the impeller pump unit 22. Specifically, the electric motor is contained within housing 24 and powered by suitable sealed electrical power line 26. A drive shaft 28 connects the electric motor to the pump impeller 30 contained within pump housing 32. Supporting drive shaft 28 is bearing 34 which serves to position and locate the drive shaft/impeller assembly. It can be appreciated that the environment in the vicinity of impeller 30 will be quite abrasive with sand, mud and rocks suspended in water which is being pumped through the pump at extremely high rates of flow. Typically, multiple shaft seals 36 of elastomeric material are used to prevent the flow of the abrasive suspension from reaching bearing 34 whose replacement generally requires complete disassembly of the apparatus. FIG. 6 is a more detailed section view of the seal portion of prior art pumps.

As shown in FIG. 6, it is conventional to utilize a shaft collar 40 mounted for rotation on drive shaft 28. Multiple shaft seals 36 do not rotate and are fitted into a portion of the pump housing 32. Each seal generally comprises an elastomer portion 42 which has a lip 44 extending therefrom. The elastomeric lips of the various seals are maintained in place by suitable metal compression rings or spirals indicated at 46. Because there is relative rotation between the seal lips 44 and the shaft collar 40, it has been found that a great deal of wear occurs along shaft collar 40 necessitating its frequent replacement during dredging operations. Generally, the seals not only prevent the abrasive suspension from reaching bearing 34 but also prevent oil utilized for lubricating bearing 34 from leaking out into the impeller portion of the pump and thus contaminating the area in which dredging operations are being undertaken. The high wear rates of shaft collars 40 and seals 36 due to the suspension and oil mixture which occurs at one or more of the seals is the primary cause for the frequent repair and replacement of these items, resulting in substantial "down" time for the dredging operation.

In many locations of the country it is necessary to conduct dredging areas adjacent a road or other body of land where there is insufficient water to float a typical dredging barge. This generally precludes the use of a cutter head/pump combination for such dredging operations. Examples of such operations might be irrigation canals, drainage ditches, etc.

Because of the necessity to move the traditional foating barge everytime a new sweep is to be done, it is very difficult to have more than one barge conducting dredging operations at a time. Accordingly, dredging operations may take extremely long periods of time because of the requirement that only a single dredging barge can be utilized. Because of the "down" time associated with the above-mentioned seal wear problems, this dredging time is made even longer.

SUMMARY OF THE INVENTION

In accordance with the above and other disadvantages of prior art dredging systems, it is an object of the present invention to provide a dredging apparatus capable of conducting dredging operation movements in both an axial and radial direction away from a floating dredge without continually repositioning the dredge.

It is a further object of the present invention to provide a single cutter head with a single pump and suitable mounting structure so as to reduce the number of cutter heads necessary to conduct dredging operations.

It is a further object of the present invention to provide an improved cutter head which is capable of providing an improved particle suspension for pumping purposes in conjunction with a single cutter head/single pump assembly.

It is a further object of the present invention to provide an improved shaft seal between a pump impeller and a main bearing in order to reduce pump "down" time caused by shaft collar and seal wear.

It is a still further object of the present invention to provide a system for mounting and operating a cutter head/impeller pump dredging system on a land vehicle whereby the dredging operation can move with respect to the vehicle in a rotational and radial direction.

It is a still further object of the present invention to provide a dredge mounting means to facilitate the interconnection of two or more floating dredges, which utilize cutter head/pump assembly supporting means which permit rotational and radial movement independent of the dredge movement, so as to permit the dredges to be mounted together and operate in conjunction with one another.

The above and other objects are achieved in accordance with the present invention by providing a dredging apparatus comprising: a means for dislodging material at the water bottom; a means for sucking said dislodged material into and propelling said dislodged material through a discharge conduit; and a means for supporting and positioning said dislodging means and said sucking and propelling means in proximity to said water bottom, said supporting means comprising a boom means pivotally mounted on a support vehicle, for movement about a vertical axis, cable means attaching said dislodging means and said sucking and propelling means to a distal end of said boom means, said boom means further including means for extending and retracting said distal end in a radial direction with respect to said vertical axis, whereby said dredging apparatus can remove a layer of bottom material by means of pivotal and radial movements of said boom means without repositioning said structure.

In a further embodiment of the present invention, the above and other objects are achieved by providing an apparatus comprising: a single means for rotationally dislodging material at said water bottom; a single means for sucking said dislodged material into and propelling said dislodged material through a discharge conduit; and means for interconnecting said rotationally dislodging means and said sucking and propelling means. In a preferred embodiment, the interconnecting means includes means locating said sucking and said propelling means vertically below said rotationally dislodging means.

The above and other objects are achieved in accordance with a further embodiment of the present invention wherein a cutter head for a rotationally dislodging means comprises a support means having two ends mountable on a rotating shaft and extending along an axis of rotation of said rotating shaft; a plurality of blade means, each of said blade means having two ends with one of said blade means ends attached approximate to one of said support means ends and the other of said blade means ends attached proximate to the other of said support means ends.

The above and other objects are achieved in accordance with a further object of the present invention in which in a submersible electric motor and pump combination for pumping water and particulate matter entrained in said water is improved, said motor and pump having coincident axes of rotation and an interconnecting shaft, said motor including a main bearing located on said shaft between said motor and said pump and a housing located around said motor and said bearing, said pump including a seal for preventing water and particulate matter in said pump from entering said bearing, an improvement comprising utilizing a single mechanical seal having rotational contact only between parts located between said pump and said bearing, said seal comprising: a first portion mounted for rotation with said shaft, said first portion comprising: a cylindrical base member fixed to said shaft; a first seal face; and a bellows section biasing said seal face in a direction away from said cylindrical base member; and a second portion comprising an adaptor plate fixed with respect to said housing; and a collar, fixed with respect to said adapter plate and having a second seal face in contact with said first seal face.

In a further embodiment of the present invention, the above and other objects are achieved by providing a dredging apparatus for removal of material from a water bottom adjacent a road or other land navigable surface including a means for supporting and positioning a cutter head/pump assembly wherein said supporting means comprises a land navigable vehicle; and boom means pivotally mounted on said vehicle for movement about a vertical axis, cable means attaching said cutter head/pump assembly to a distal end of said boom means, said boom means further including means for extending and retracting said distal end in a radial direction with respect to said vertical axis, whereby said cutter head/pump assembly can remove a layer of bottom material by means of pivotal and radial movements of said boom means without repositioning said land navigable vehicle.

The above and other objects of the present invention are also achieved in providing a tab located on a dredging barge and a pin means for linking said tab together with a similar tab on a like barge in order that said barges, equipped with boom means, may be operated simultaneously and in proximate position to another.

BRIEF DESCRIPTION OF THE DRAWINGS

The above and other objects will become more apparent from the following description of the accompanying drawings, wherein.

DETAILED DESCRIPTION OF THE PREFERRED EMBODIMENTS

Figure 1:
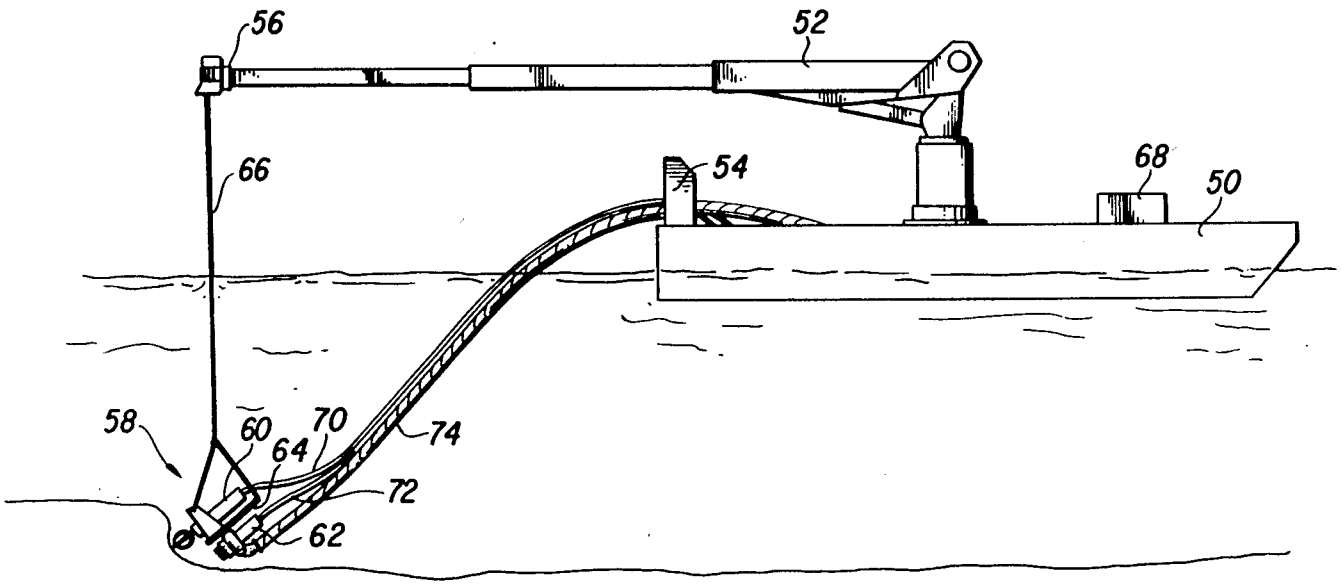
FIG. 1 is a side view of a dredging barge and cutter head/pump assembly in accordance with the present invention.

Referring now to the drawings in which like reference numerals indicate similar elements in respective views, FIG. 1 illustrates a floating barge 50 upon which a supporting and positioning means such as boom 52 is mounted. The boom is pivotable in the horizontal plane about a vertical axis and can be radially extended and retracted by means of suitable hydraulic controls controlled by control panel 54. At a distal end 56 of boom 52, a dredging apparatus 58 is suspended. The apparatus comprises a cutter head assembly 60, a pump assembly 62 and an interconnecting means for connecting the two structures and the entire apparatus is suspended by cable 66. Hydraulic or, in a preferred embodiment, electric power is provided by generator 68 and is carried to the cutter head and pump assembly motors in lines 70 and 72, respectively. A suspension of water and dislodged bottom materials is sucked into pump assembly 62 and is propelled through discharge conduit 74 to be deposited either in the barge or, more preferably, at a point remote from dredging operations. Because of the mobility of the distal end of the boom a much larger area can be dredged without moving the barge.

Figure 2:
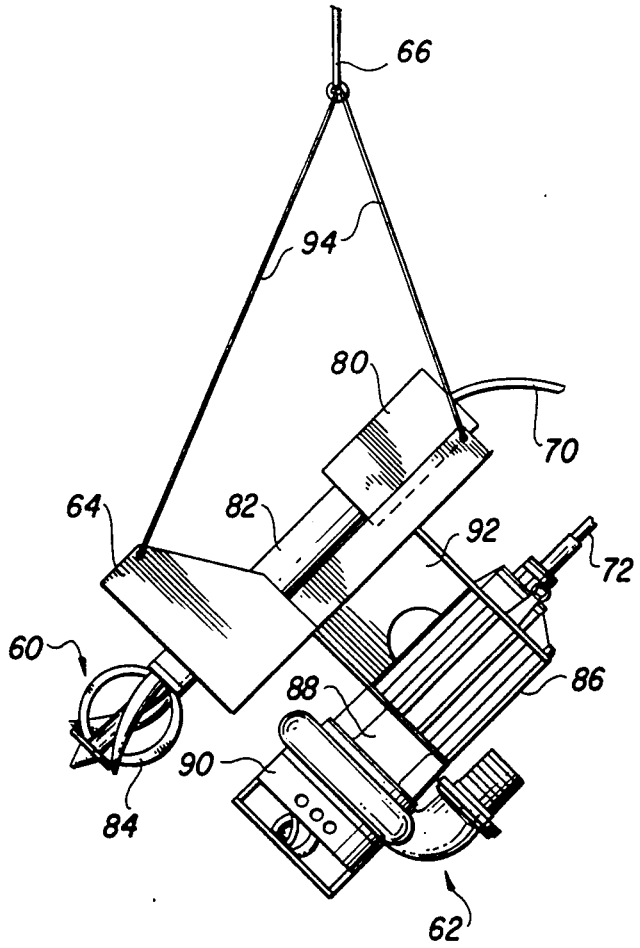
FIG. 2 is a side view on a larger scale of the cutter head/pump assembly in accordance with the present invention.
Figure 3:
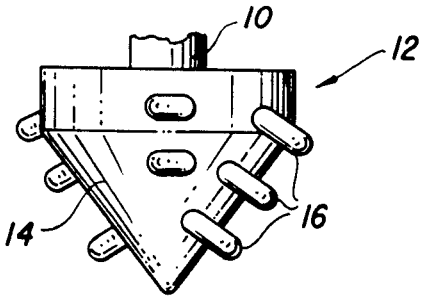
FIG. 3 (PRIOR ART)
FIG. 3 is a side view of a prior art cutter head assembly.

A more detailed view of the dredging apparatus 58 can be seen in FIG. 2. The cutter head assembly 60 comprises a submersible electric motor 80, a shaft housing 82 and the cutter head 84. The pump assembly 62 comprises an electric motor 86, a shaft housing 88 and the pump 90. Mounting structure 64 includes a portion attached to the cutter head assembly and a portion 92 attached to the pump assembly. Suitable cables 94 attach the mounting structure 64 to the main support cable 66. It is important to know that it has been found particularly advantageous to locate the cutter head assembly over the pump assembly so that the cutter head is above and just forward of the pump assembly inlet. This organization permits the maximum intake of dislodged and entrained bottom materials by the pump for a given size cutter assembly.

Figure 4:
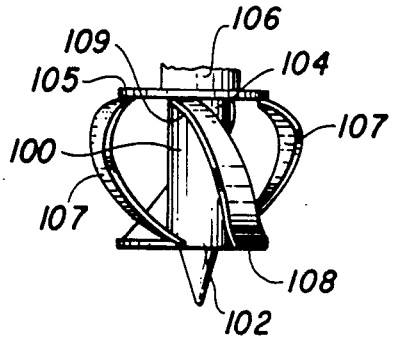
FIG. 4 is a side view of a cutter head assembly in accordance with the present invention.

FIG. 4 is a detailed view of the cutter head in accordance with one embodiment of the present invention. A support means 100 has ends 102 and 104, the latter of which is mountable on the rotating shaft 106 which is connected to the cutter head assembly electric motor 80. A plurality of blades 107 (in the illustrated embodiment numbering 4) each having two ends 108 and 109 are disposed around and connected to the support means 100. Each blade is connected at one end 108 to one end 102 of the support means and attached at the other end 109 to the support member 105 on the other end 104 of the support means. Additionally, the mid portion of each blade extends radially outwards from the axis of rotation of the support means 100 and shaft 106. The ends 108 of blades 107 which are attached to end 102 extend radially outwards from end 102 and, during rotation of the cutter head, gouge and dislodge bottom material into a thick suspension which is sucked into the pump assembly. This provides an improved cutting ability at a lower power requirement.

Figure 5:
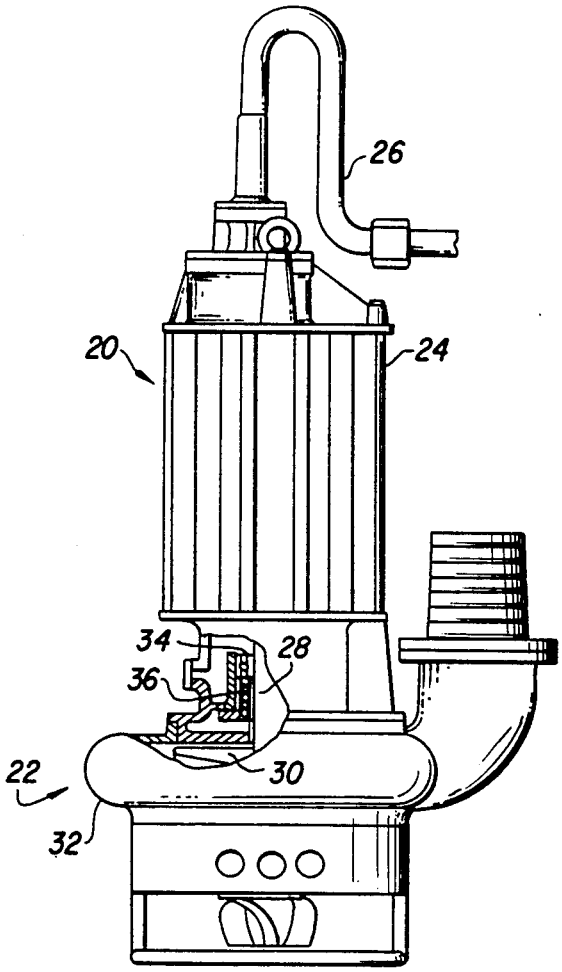
FIG. 5 (PRIOR ART)
FIG. 5 is a partially cut-away view of an electric motor and impeller pump assembly showing the main bearing and prior art seal.
Figure 6:
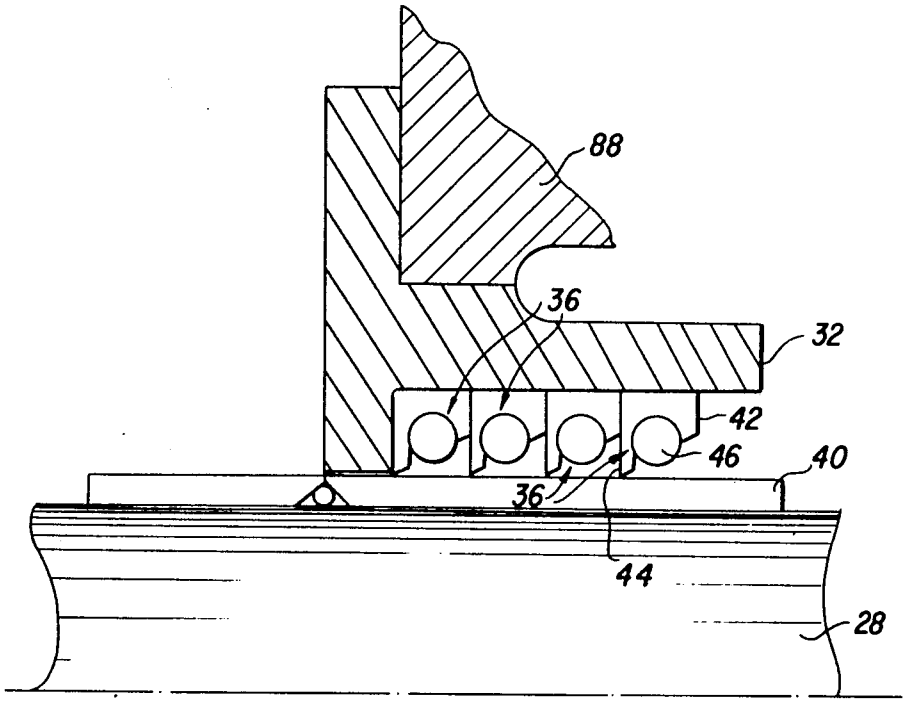
FIG.6 (PRIOR ART)
FIG. 6 is a side view of the prior art seal of FIG. 5.
Figure 7:
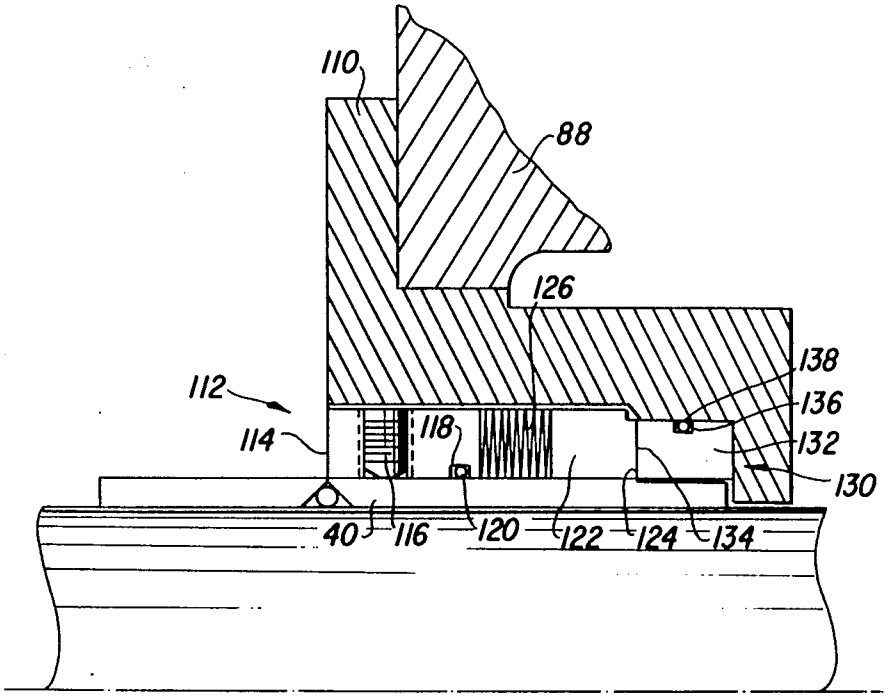
FIG. 7 is a side view partially in section of an electric motor pump assembly seal in accordance with the present invention.

As discussed previously with respect to FIGS. 5 and 6, the commonly utilized shaft seals 36 do not provide a sufficient enough seal so as to preclude extensive wear of the shaft collar and the need for frequent disassembly and replacement. Applicant has surprisingly found that a mechanical seal, instead of the conventional elastomeric seal, does a better job sealing in this extremely abrasive environment. FIG. 7 illustrates an adaptor plate 110 inserted into shaft housing 88 during assembly. A two-part mechanical bellows seal, for example one made by Borg Warner identified as seal BX2750 available from the Mechanical Seal Division, 27941 Front St., Temechula, Calif. 92390 has been utilized. A first portion 112 of the mechanicl seal assembly includes a cylindrical base member 114 which is affixed to shaft collar 40 by means of set screws 116. In an inner circumferential groove 118, an O-ring 120 is sealingly disposed. Also in the first portion 112 there is a cylindrical sealing member 122 having a first seal face 124 located thereon. Sealingly connecting sealing member 122 and cylindrical base member 114 is a mechanical bellows assembly 126 which serves to bias the sealing member 122 away from the cylindrical base member 114.

A second portion 130 of the mechanical seal is pressed into or otherwise fixed in relationship with adaptor plate 110 which serves to locate the seal in shaft housing 88. The second portion includes a generally cylindrical member 132 having a second seal face 134 located thereon. Around the periphery of cylindrical member 132 is a groove 136 with an O-ring 138 sealingly disposed therein.

In practice, the electric motor and pump assembly is disassembled and the portion of the pump housing 32 which serves to mount shaft seals 36 is discarded along with the seals themselves. A new adaptor plate 110 is constructed which can be mounted within shaft housing 88 and serves to mount, as a press fit therein, the second portion 130 of the mechanical seal assembly. The first portion 112 is then located over shaft collar 40 and set screws 116 tightened such that during final assembly, the first and second seal faces are biased together by mechanical bellows 126. First and second seal faces 124 and 134, respectively, may be carbon, ceramic, tungsten carbide or silicon carbide as desired. They are characterized by extremely high abrasion resistance and provide much greater wear resistance and less "down" time in an underwater dredging appratus than do conventional elastomer seals.

Figure 8:
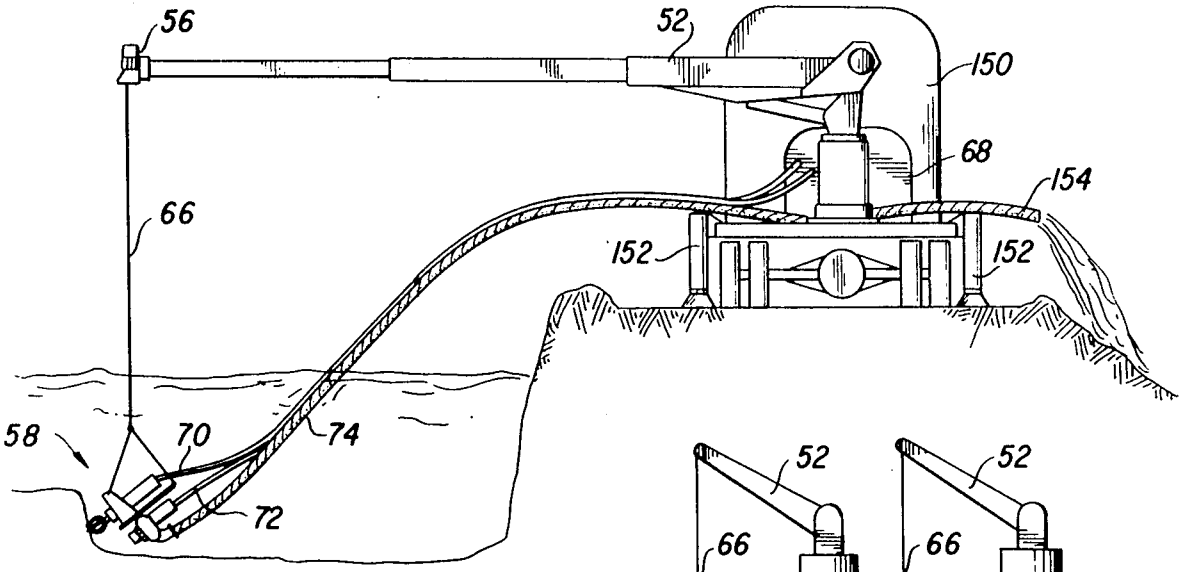
FIG. 8 is an end view of a further embodiment of the present invention in which a pivotally and radially positionable cutter head/pump assembly is mounted on a land vehicle.

A further preferred embodiment of the present invention is illustrated in FIG. 8, wherein the extensible/retractable boom 52 is mounted on a truck 150 along with generator 68. Independently controllable hydraulic jacks 152 can be extended or retracted on either side of the truck in order to provide an extremely stable mounting base for the boom 52. As in FIG. 1, the boom at its distal end 56 has a cable 66 supporting a dredging apparatus 58. Discharge conduit 74 has an outlet 154 in order to discharge water, and bottom material entrained therein, away from dredging operations.

Figure 9:
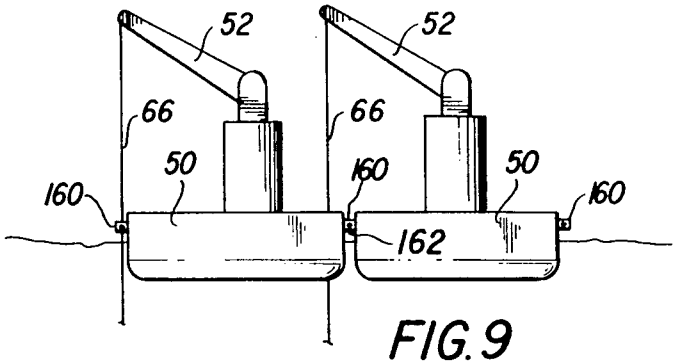
FIG. 9 is a side view illustrating a further embodiment of the present invention in which a plurality of dredging barges can be interconnected to increase the dredging rate of a dredging operation.

In FIG. 9, two dredging barges 50 are schematically represented with extensible booms 52 mounted thereon and cables 66 supporting dredging apparatuses (not shown). The barges are equipped with mounting tabs 160 which can extend from more than one side of each barge. In a preferred embodiment there would be two of such tabs, one at the forward end and one at the aft end of each barge on each side to be connected. It can be seen that a pivot means such as bolt 162 serving to interconnect tabs 160 of adjoining floating barges, the two barges can operate in conjunction with one another providing a much higher rate of dredging or covering a broader area with the same dredging rate.

It will be seen that operation of the dredging assembly in FIGS. 1 and 8 will be similar. Initially, the supporting vehicle either barge 50 or truck 150 will be positioned and the barge anchored and the truck secured by lowering jacks 152. A cable hoist at the distal end of the boom 56 will lower dredging apparatus 58 into the water until it is in proximity with the bottom surface to be removed. Power is applied to both the cutter head assembly and the pump assembly and dredging operations are commenced. The boom can be pivoted about its vertical axis so as to move the dredging apparatus in an arc covering the area to be dredged. After one arc sweep has been completed, boom 52 can be extended radially outward and another arc undertaken. In a preferred embodiment, the boom can be fully extended for a distance of 40 feet from its vertical rotational axis. After reaching the limit of its reach, the dredging apparatus would be lifted and the anchors repositioned in FIG. 1 or the jacks 152 retracted, the track moved and jacks 152 reextended in FIG. 8. Then another sequence of dredging operations would be undertaken.

It can be seen that mobility of the FIGS. 1 and 8 embodiments coupled with the pivotable and radial movements of the boom permits an extensive area to be dredged before movement of the support vehicle is necessary. This is a major benefit of the present invention, as it eliminates the need for almost continual repositioning of the dredging vessel which in the past were equipped with A arms or ladder assemblies which do not permit pivotal and radial movement of the dredging apparatus with respect to the support vehicle.

In preferred embodiments of the present invention, a single cutter head assembly can be utilized in conjunction with a single pump, and in a preferred embodiment, the cutter head assembly is located above and forward of the pump inlet so as to permit optimum flow of dislodged material into the pump. In a further preferred embodiment, the cutter head comprises a plurality of blades attached at both ends in much the same manner as an egg beater to dislodge bottom material and suspend the same in the surrounding water in order that it may be pumped into an inlet of and expelled from the discharge conduit of a submarine pump. In a further preferred embodiment, the pump assembly has a mechanical seal substituted for the conventional series of elastomeric seals in order to provide high bearing life and low maintenance and maximize operational time at the dredging site.

In accordance with the above disclosure, many applications and embodiments of the present invention will be obvious to those of ordinary skill in the art. For example, although a preferred embodiment utilizes a single cutter head assembly located directly above the intake pump, multiple cutter head assemblies and/or multiple pumps could be utilized. The preferred arrangement is the cutter head above the pump although there may be situations in which a degraded embodiment with the pump located over the cutter head is advantageous. Applicants' invention is distinguished by the use of a boom 52 which is rotatable about a vertical axis and is extensible and retractable, obviating the need to incrementally reposition the support vehicle during operations. In conjunction with such a dredging apparatus, different cutter head assemblies could be used other than the preferred embodiment illustrated in FIG. 4.

Therefore, although the present specification is by way of example and description of preferred embodiments of the present invention, it is by no means limiting thereof of applicants' invention. The invention is limited only by the following claims appended hereto.

What is claimed is:

1. A dredging apparatus for moving material from a water bottom, said apparatus comprising:

means for dislodging material at said water bottom;

means for sucking said dislodged material into and propelling said dislodged material through a discharge conduit; and means for supporting and positioning said dislodging means and said sucking and propelling means in proximity to said water bottom, said supporting means comprising boom means, pivotally mounted on a support vehicle for movement about a vertical axis, cable means attaching said dislodging means and said sucking and propelling means to a distal end of said boom means, said boom means including means for extending and retracting said distal end in a radial direction with respect to said vertical axis, whereby said dredging apparatus can remove a layer of bottom material by means of pivotal and radial movements of said boom means without repositioning said support vehicle, wherein said dislodging means comprising a submersible electric motor; cutter head means; and shaft means interconnecting said electric motor and said cutter head means, said cutter head comprising:

a support means having two ends mountable on said rotating shaft, and extending along an axis of rotation of said rotating shaft said support means including a support member extending outwardly of said support means at one end;

a plurality of blade means, each of said blade means having two ends with one of said blade means ends attached to said support member outwardly of said support means and the other of said blade means ends attached directly to the other of said support means ends, wherein each of said blade means includes a mid portion between said blade means ends and said mid portion extends radially outwards of said axis of rotation and said blade means ends attached to said support member are further from said axis of rotation than said blade means end attachment on said support means.

2. The dredging apparatus in accordance with claim 1, wherein said sucking means comprises a submersible electric motor; and impeller pump and discharge nozzle; and shaft means interconnecting said electric motor and said impeller pump.

3. The dredging apparatus according to claim 2, wherein said electric motor, said pump and said shaft means have coincident axes of rotation, said motor including a main bearing located on said shaft between said motor and said pump and a housing located around said motor and said bearing, said pump including a seal for preventing water and particulate matter in said pump from entering said bearing, said improvement comprising: utilizing a mechanical seal wherein rotational contact is between only parts located between said pump and said bearing, said seal comprising:

a first portion mounted for rotation with said shaft, said first portion comprising:
a cylindrical base member fixed to said shaft;
a first seal face; and
a bellows section biasing said seal face in a direction away from said cylindrical base member; and
a second portion comprising:
an adapter plate fixed with respect to said housing; and
a collar, fixed with respect to said adapter plate and having a second seal face in contact with said first seal face.

4. The dredging apparatus in accordance with claim 2, wherein said extending and retracting means comprises:
a telescopic boom;
hydraulic cylinder means for extending and retracting said telescopic boom; and
a source of high pressure hydraulic fluid for powering said hydraulic cylinder, wherein said electric motor, impeller pump and shaft means have coincident axes of rotation, said motor including a main bearing located on said shaft between said motor and said pump and a housing located around said motor and said bearing, said pump including a seal for preventing water and particulate matter in said pump from entering said bearing, said improvement comprising: utilizing a mechanical seal wherein rotational contact is between only parts located between said pump and said bearing, said seal comprising:
a first portion mounted for rotation with said shaft, said first portion comprising;
a cylindrical base member fixed to said shaft;
a first seal face; and
a bellows section biasing said seal face in a direction away from said cylindrical base member; and
a second portion comprising:
an adapter plate fixed with respect to said housing; and
a collar, fixed with respect to said adaptor plate and having a second seal face in contact with said first seal face.

5. The dredging apparatus according to claim 1, wherein said extending and retracting means comprises:
a telescopic boom;
hydraulic cylinder means for extending and retracting said telescoping boom; and
a source of high pressure hydraulic fluid for powering said hydraulic cylinder.

6. The dredging apparatus according to claim 1, further including interconnecting means, attached to said cable means, for mounting said dislodging means and said sucking and propelling means.

7. The dredging apparatus according to claim 6, wherein said sucking and propelling means has an inlet and
said interconnecting means includes means mounting said dislodging means vertically above said sucking and propelling means inlet.

8. The dredging apparatus in accordance with claim 1, wherein said support vehicle is a land navigable vehicle.

9. The dredging apparatus in accordance with claim 1, wherein said supporting vehicle is a water navigable vehicle.

10. The dredging apparatus in accordance with claim 9, wherein said barge includes means for linking said barge to another like barge for joint operation.

11. The dredging apparatus in accordance with claim 10, wherein said linking means comprises:
tab means located on each of said barges extending outwardly of the side of each barge; and
pin means for linking said tabs together.

* * * * *